US009386894B1

(12) United States Patent
Kerigan et al.

(10) Patent No.: US 9,386,894 B1
(45) Date of Patent: Jul. 12, 2016

(54) VACUUM CLEANER WITH EDGE BLOWER FEATURE

(71) Applicants: Patrick Kerigan, Redondo Beach, CA (US); Andrew Lord, Redondo Beach, CA (US); Lynn Kerigan, Mexico Beach, FL (US)

(72) Inventors: Patrick Kerigan, Redondo Beach, CA (US); Andrew Lord, Redondo Beach, CA (US); Lynn Kerigan, Mexico Beach, FL (US)

( * ) Notice: Subject to any disclaimer, the term of this patent is extended or adjusted under 35 U.S.C. 154(b) by 0 days.

(21) Appl. No.: 14/827,827

(22) Filed: Aug. 17, 2015

(51) Int. Cl.
*A47L 5/14* (2006.01)
*A47L 9/08* (2006.01)
*A47L 9/28* (2006.01)

(52) U.S. Cl.
CPC ... *A47L 5/14* (2013.01); *A47L 9/08* (2013.01); *A47L 9/2805* (2013.01); *A47L 9/2852* (2013.01); *A47L 9/2857* (2013.01)

(58) Field of Classification Search
CPC ..... A47L 5/14; A47L 9/08; A47L 9/2805; A47L 9/2852; A47L 9/2857
USPC ..... 15/319, 346, 340.1
See application file for complete search history.

(56) References Cited

U.S. PATENT DOCUMENTS

| | | | |
|---|---|---|---|
| 3,268,942 | A | 8/1966 | Rossnan |
| 3,694,848 | A | 10/1972 | Alcala |
| 4,300,261 | A | 11/1981 | Woodward et al. |
| 4,315,344 | A | 2/1982 | Woodward et al. |
| 4,884,315 | A | 12/1989 | Ehnert |
| 6,245,159 | B1 | 6/2001 | Deng |
| 7,555,812 | B1 | 7/2009 | Pinney |
| 7,610,651 | B2 | 11/2009 | Baek |

*Primary Examiner* — David Redding
(74) *Attorney, Agent, or Firm* — Kenneth L. Green; Averill & Green

(57) ABSTRACT

A vacuum cleaner provides a jet of high velocity air into debris resting along a floor edge. The jet of air is aimed down and to the side of the vacuum cleaner vacuum head. The jet of air dislodges the debris urging the debris into the path of the vacuum head. The jet of air is conveniently created from the vacuum cleaner exhaust, and a left or right jet may be manually selected, or automatically selected by a wall detection sensor.

15 Claims, 2 Drawing Sheets

VACUUM CLEANER WITH EDGE BLOWER FEATURE

BACKGROUND OF THE INVENTION

The present invention relates to vacuum cleaners and in particular to a vacuum cleaner with an air jet for dislodging debris along floor edges.

Debris commonly collects along floor edges at the bases of walls. Generally, even if a user maneuvers the vacuum cleaner against the wall, much of the debris escapes capture by the vacuum cleaner. Hand attachments are often provided to draw the debris in to the vacuum cleaner, but require manipulating a hose, involving detaching an end of the hose, attaching a nozzle to the hose, dragging the tip of the nozzle along the edge of the floor, detaching the nozzle, and reattaching the hose end to the vacuum cleaner. Such exercises may be required several time in the course of cleaning a floor and becomes tedious.

U.S. Pat. No. 7,610,651 discloses an Automatic Cleaning Device with an air injector 50 and cooperating auxiliary cleaner 60 to urge debris towards a suction head 20, shown as prior art in FIG. 1. Unfortunately, the air injector 50 comprises a large diameter air injection pipe 51 directing a low velocity air flow against an adjacent wall, and the suction head is fairly narrow requiring the auxiliary cleaner 60 to push the debris inward towards the suction head 20. Because the auxiliary cleaner 60 must reach outside the body 10, portions of the auxiliary cleaner 60 are subject to accelerated wear.

BRIEF SUMMARY OF THE INVENTION

The present invention addresses the above and other needs by providing a vacuum cleaner which provides a jet of high velocity air into debris resting along a floor edge. The jet of air is aimed down and to the side of the vacuum cleaner vacuum head. The jet of air dislodges the debris urging the debris into the path of the vacuum head. The jet of air is conveniently created from the vacuum cleaner exhaust, and a left or right jet may be manually selected, or automatically selected by a wall detection sensor.

In accordance with one aspect of the invention, there is provided a high velocity air jet into a floor edge at the base of a wall. The air jet is directed down and forward to dislodge debris resting at the base of a wall or other vertical floor boundary.

BRIEF DESCRIPTION OF THE SEVERAL VIEWS OF THE DRAWING

The above and other aspects, features and advantages of the present invention will be more apparent from the following more particular description thereof, presented in conjunction with the following drawings wherein.

Corresponding reference characters indicate corresponding components throughout the several views of the drawings.

DETAILED DESCRIPTION OF THE INVENTION

The following description is of the best mode presently contemplated for carrying out the invention. This description is not to be taken in a limiting sense, but is made merely for the purpose of describing one or more preferred embodiments of the invention. The scope of the invention should be determined with reference to the claims.

Figure 1:
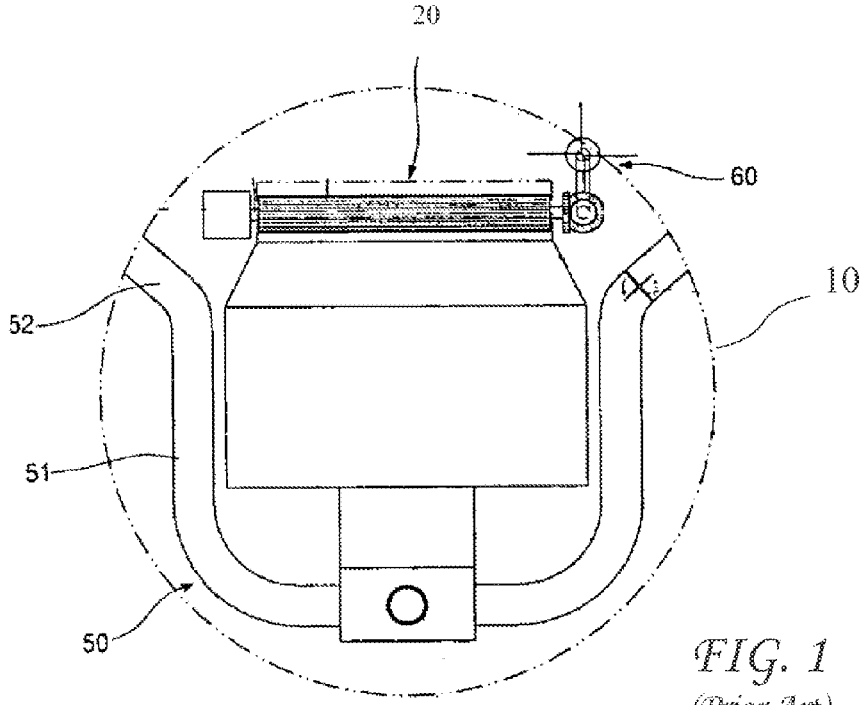
FIG. 1 (Prior Art)
FIG. 1 shows a prior art automated vacuum cleaner having a wall cleaning discharge of air.
Figure 2:
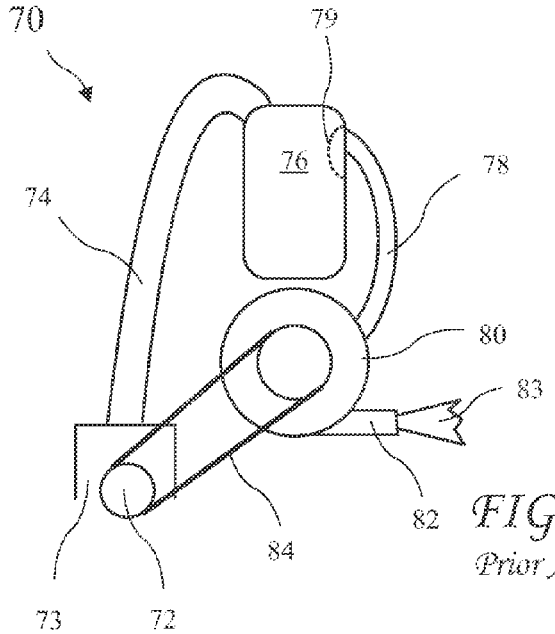
FIG. 2 (Prior Art)
FIG. 2 shows functional elements of a prior art vacuum cleaner.

The functional elements of a prior art vacuum cleaner 70 are shown in FIG. 2. The elements include a roller brush 72 residing in a suction area 73, a first suction hose (or passage) 74 drawing air and debris from the suction area 73, a debris collection bag (or container) 76 receiving the debris from the from the first hose 74, a second suction hose drawing a vacuum in the collection bag 76 through a filter (or strainer) 79, and an air pump 80 drawing vacuum through the second hose 78 and exhausting air 83 through exhaust port 82. A belt 84 connects the air pump 80 to the roller brush 72 to spin the roller brush when the vacuum cleaner is operating.

Figure 3B:
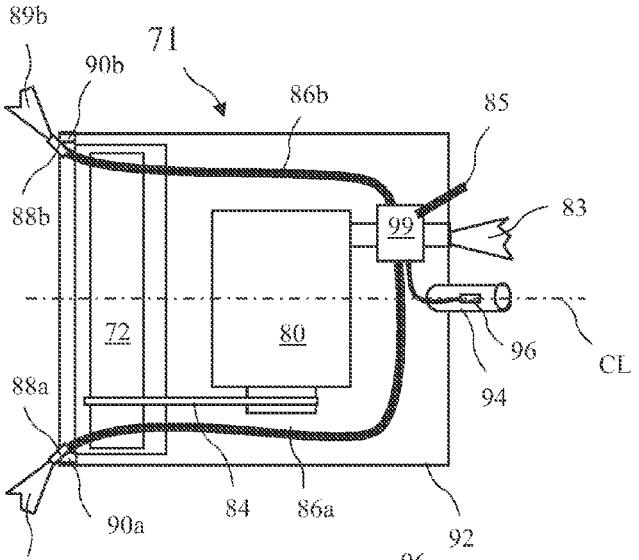
FIG. 3B shows a top view of elements of the vacuum cleaner including an angled debris nozzle according to the present invention.
Figure 3A:
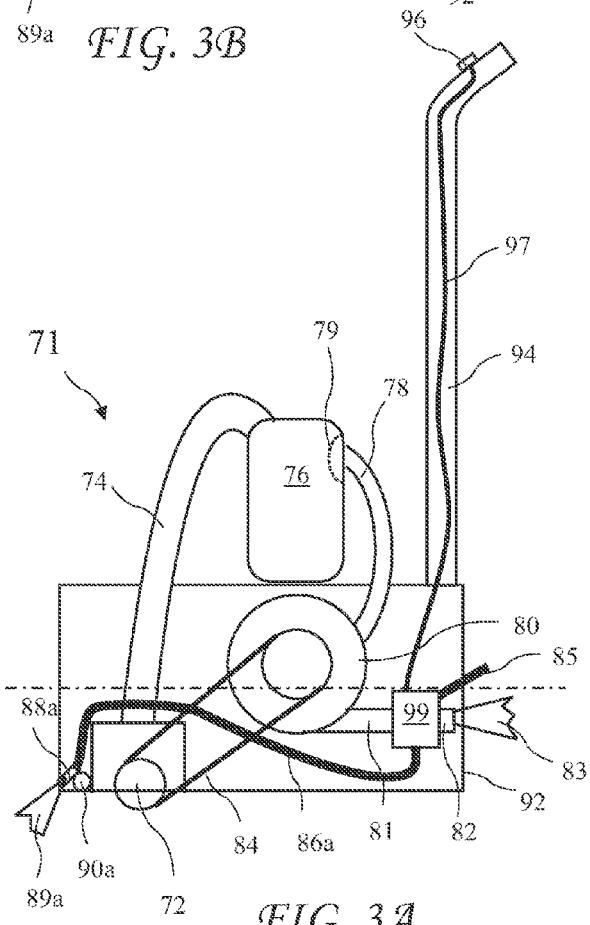
FIG. 3A shows a side view of elements of a vacuum cleaner including an angled debris nozzle according to the present invention.

A left side view of elements of a vacuum cleaner 71 including an angled debris nozzle 88*a* according to the present invention is shown in FIG. 3A and a top view of elements of the vacuum cleaner 71 including an angled debris nozzles 88*a* and 88*b* is shown in FIG. 3B. In addition to the elements of the prior art vacuum cleaner in FIG. 2, the vacuum cleaner 71 includes the debris nozzles 88*a* and 88*b* at front corners of the vacuum cleaner 71. A valve 99 connected to an intermediate port 81 interrupts a flow to the exhaust port 82 and selectively diverts some or all of the exhausting air 83 through the nozzles 88*a* or 88*b* through hoses 86*a* and 86*b* providing jets of air 89*a* and 89*b* respectively.

The valve 99 may be controlled manually by a mechanical lever 85, by a switch 96 attached to a vacuum handle 94, or by sensors 90*a* and 90*b*. The mechanical lever 85 may protrude allowing actuation by a users foot or hand and has a center position controlling the valve to release all of the air flow through the exhaust port 82 a left position releasing some or all of the air flow through the left nozzle 88*a*, and a right position releasing some or all of the air flow through the right nozzle 88*b*. The vacuum cleaner 71 has a centerline CL.

The switch 96 may have two, three, or four positions. A two position switch may have OFF and ON, where the valve 99 is off and all of the air 83 is exhaust directly out of the vacuum cleaner 71, and an ON position where sensors 90*a* and 90*b* control the valve 99 to direct air 83 through the left or right nozzle 88*a* and 88*b* respective. A three position switch may have OFF, LEFT, and RIGHT positions to direct all of the air 83 out through the exhaust 83, or to divert some or all of the air 83 to the left or right nozzle 88*a* or 88*b*. A four position switch may have OFF, LEFT, RIGHT and ON positions to direct all of the air 83 out through the exhaust 83, or to divert some or all of the air 83 to the left or right nozzle 88*a* or 88*b*, or to the ON position where sensors 90*a* and 90*b* control the valve 99 to direct air 83 through the left or right nozzle 88*a* and 88*b* respective.

The sensors 90*a* and 90*b* are proximity sensors sensing the presence of a surface to the left and right respectively, preferably sensing the presence of a wall. The proximity sensors 90*a* and 90*b* may be sound based (e.g., ultra sonic, or light based (e.g., laser or infrared), and need only have a short range, for example, four inches, and have a narrow vertical beam to avoid false alarms.

Figure 4B:
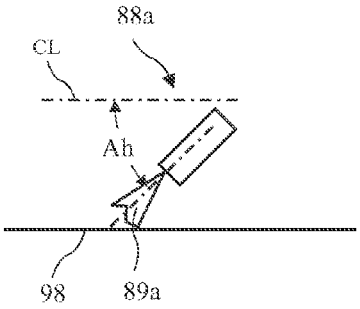
FIG. 4B shows a horizontal angle of the jet of air for dislodging debris along the edge of a floor.
Figure 4A:
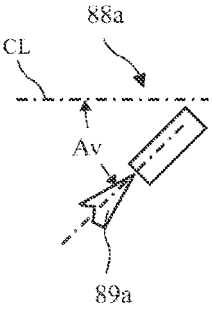
FIG. 4A shows a vertical angle of a jet of air for dislodging debris along the edge of a floor.

A vertical angle Av of the jet of air for 89*a* for dislodging debris along the edge of a floor is shown in FIG. 4A and a horizontal angle Ah of the jet of air 89*a* for dislodging debris along the edge of a floor at the base of a wall 98 is shown in FIG. 4B. The vertical angle Av is preferably between 20 and 70 degrees, and more preferably between 30 and 60 degrees, and most preferably 45 degrees. The horizontal angle Ah is preferably between 20 and 70 degrees, and more preferably between 30 and 60 degrees, and most preferably 45 degrees.

In one embodiment, the nozzles are user adjustable to point down and to the right or left at user preferred angles.

While the invention herein disclosed has been described by means of specific embodiments and applications thereof, numerous modifications and variations could be made thereto by those skilled in the art without departing from the scope of the invention set forth in the claims.

We claim:

1. A vacuum cleaner comprising:

a suction area in fluid communication with a surface under the vacuum cleaner, an air pump providing an air flow;

a left nozzle residing at a left front corner of the vacuum cleaner base and pointed down and to the left of the suction area;

a right nozzle at a right front corner of the vacuum cleaner base and pointed down and to the right and to the left of the suction area; and a valve controllable to place the air flow in fluid communication with at least one of an exhaust port, the left nozzle and the right nozzle, wherein:

the left and right nozzles adjustable to point down at a user preferred angle below horizontal.

2. The vacuum cleaner of claim 1, wherein:

the left nozzle is pointed down between 20 and 70 degrees below horizontal; and the right nozzle is pointed down between 20 and 70 degrees below horizontal.

3. The vacuum cleaner of claim 2, wherein:

the left nozzle is pointed down between 30 and 60 degrees below horizontal; and the right nozzle is pointed down between 30 and 60 degrees below horizontal.

4. The vacuum cleaner of claim 3, wherein:

the left nozzle is pointed down 45 degrees below horizontal; and the right nozzle is pointed down between 45 degrees below horizontal.

5. The vacuum cleaner of claim 1, wherein:

the left nozzle is pointed to the left of a vacuum cleaner centerline CL between 20 and 70 degrees; and the right nozzle is to the right of the vacuum cleaner centerline CL between 20 and 70 degrees.

6. The vacuum cleaner of claim 5, wherein:

the left nozzle is pointed to the left of a vacuum cleaner centerline CL between 30 and 60 degrees; and the right nozzle is to the right of the vacuum cleaner centerline CL between 30 and 60 degrees.

7. The vacuum cleaner of claim 6, wherein:

the left nozzle is pointed to the left of a vacuum cleaner centerline CL 45 degrees; and the right nozzle is to the right of the vacuum cleaner centerline CL 45 degrees.

8. A vacuum cleaner comprising:

a suction area in fluid communication with a surface under the vacuum cleaner, an air pump providing an air flow;

a left nozzle residing at a left front corner of the vacuum cleaner base and pointed down and to the left of the suction area;

a right nozzle at a right front corner of the vacuum cleaner base and pointed down and to the right and to the left of the suction area; and a valve controllable to place the air flow in fluid communication with at least one of an exhaust port, the left nozzle and the right nozzle, wherein:

the left nozzle is adjustable to point to the left of a vacuum cleaner centerline CL at a user selectable angle; and the right nozzle is adjustable to point to the right of a vacuum cleaner centerline CL at a user selectable angle.

9. A vacuum cleaner comprising:

a suction area in fluid communication with a surface under the vacuum cleaner, an air pump providing an air flow;

a left nozzle residing at a left front corner of the vacuum cleaner base and pointed down and to the left of the suction area;

a right nozzle at a right front corner of the vacuum cleaner base and pointed down and to the right and to the left of the suction area;

a valve controllable to place the air flow in fluid communication with at least one of an exhaust port, the left nozzle and the right nozzle; and a mechanical lever operatively connected to the valve and having a center position controlling the valve to release all of the air flow through the exhaust port, a left position releasing at least some of the air flow through the left nozzle, and a right position releasing at least some of the air flow through the right nozzle.

10. A vacuum cleaner comprising:

a suction area in fluid communication with a surface under the vacuum cleaner, an air pump providing an air flow;

a left nozzle residing at a left front corner of the vacuum cleaner base and pointed down and to the left of the suction area;

a right nozzle at a right front corner of the vacuum cleaner base and pointed down and to the right and to the left of the suction area;

a valve controllable to place the air flow in fluid communication with at least one of an exhaust port, the left nozzle and the right nozzle; and left and right proximity sensors, wherein the left proximity sensor switches the valve to a left position releasing at least some of the air flow through the left nozzle, and the right proximity sensor switches the valve to a right position releasing at least some of the air flow through the right nozzle.

11. The vacuum cleaner of claim 10, further including a handle switch having at least two positions, wherein in an OFF position the valve provides all of the air flow through the exhaust port, and an ON position wherein the proximity sensors control the release of air flow through the left nozzle and through the right nozzle.

12. A vacuum cleaner comprising:

a suction area in fluid communication with a surface under the vacuum cleaner, an air pump providing an air flow;

a left nozzle residing at a left front corner of the vacuum cleaner base and pointed down and to the left of the suction area;

a right nozzle at a right front corner of the vacuum cleaner base and pointed down and to the right and to the left of the suction area;

a valve controllable to place the air flow in fluid communication with at least one of an exhaust port, the left nozzle and the right nozzle; and a handle switch having at least three positions, wherein in an OFF position the valve provides all of the air flow through the exhaust port, a LEFT position wherein at least some of the air flow through the left nozzle, and in a RIGHT position wherein at least some of the air flow through the right nozzle.

13. The vacuum cleaner of claim 12, wherein the handle switch has four positions, including:

an OFF position the valve provides all of the air flow through the exhaust port;

a LEFT position wherein at least some of the air flow through the left nozzle;

a RIGHT position wherein at least some of the air flow through the right nozzle; and an AUTO position wherein the air flow is controlled by the sensors.

14. A vacuum cleaner comprising:

a suction area in fluid communication with a surface under the vacuum cleaner, an air pump providing an air flow;

a left nozzle at a left front corner of the vacuum cleaner base and to the left of the suction area, and pointed down between 20 and 70 degrees below horizontal and between 20 and 70 degrees to the left of the vacuum cleaner centerline CL;

a right nozzle at a right front corner of the vacuum cleaner base and to the right of the suction area, and pointed down between 20 and 70 degrees below horizontal and between 20 and 70 degrees to the right of the vacuum cleaner centerline CL;

a valve controllable to place the air flow in fluid communication with at least one of an exhaust port, the left nozzle and the right nozzle; and a switch attached to the vacuum cleaner and having at least three positions, wherein in an OFF position the valve provides all of the air flow through the exhaust port, a LEFT position wherein at least some of the air flow through the left nozzle, and in a RIGHT position wherein at least some of the air flow through the right nozzle.

15. A vacuum cleaner comprising:

a suction area in fluid communication with a surface under the vacuum cleaner, an air pump providing an air flow;

a left nozzle at a left front corner of the vacuum cleaner base and to the left of the suction area, and pointed down between 39 and 60 degrees below horizontal and between 39 and 60 degrees to the left of the vacuum cleaner centerline CL;

a right nozzle at a right front corner of the vacuum cleaner base and to the right of the suction area, and pointed down between 39 and 60 degrees below horizontal and between 39 and 60 degrees to the right of the vacuum cleaner centerline CL;

a valve controllable to place the air flow in fluid communication with at least one of an exhaust port, the left nozzle and the right nozzle;

left and right proximity sensors, wherein the left proximity sensor switches the valve to a left position releasing at least some of the air flow through the left nozzle, and the right proximity sensor switches the valve to a right position releasing at least some of the air flow through the right nozzle; and a switch attached to the vacuum cleaner and having at least four positions, including:

an OFF position the valve provides all of the air flow through the exhaust port;

a LEFT position wherein at least some of the air flow through the left nozzle;

a RIGHT position wherein at least some of the air flow through the right nozzle; and an AUTO position wherein the air flow is controlled by the sensors.

* * * * *